US006609510B2

(12) United States Patent
Takahashi et al.

(10) Patent No.: US 6,609,510 B2
(45) Date of Patent: Aug. 26, 2003

(54) DEVICE AND METHOD FOR CONTROLLING AIR-FUEL RATIO OF INTERNAL COMBUSTION ENGINE

(75) Inventors: Koji Takahashi, Atsugi (JP); Shigeo Ohkuma, Atsugi (JP)

(73) Assignee: Unisia Jecs Corporation, Kanagawa-Ken (JP)

( * ) Notice: Subject to any disclaimer, the term of this patent is extended or adjusted under 35 U.S.C. 154(b) by 8 days.

(21) Appl. No.: 10/003,534

(22) Filed: Dec. 6, 2001

(65) Prior Publication Data

US 2002/0069864 A1 Jun. 13, 2002

(30) Foreign Application Priority Data

Dec. 7, 2000 (JP) ..... 2000-373500

(51) Int. Cl.[7] ..... F02D 41/14
(52) U.S. Cl. ..... 123/682; 123/703
(58) Field of Search ..... 123/681, 682, 123/703

(56) References Cited

U.S. PATENT DOCUMENTS 4,321,903 A * 3/1982 Kondo et al. ..... 123/682
4,337,746 A * 7/1982 Masaki ..... 123/691
4,586,478 A * 5/1986 Nogami et al. ..... 123/682
4,922,877 A * 5/1990 Nagaishi ..... 123/682
5,168,700 A * 12/1992 Furuya ..... 60/274
5,394,691 A * 3/1995 Seki ..... 60/276
5,433,185 A * 7/1995 Toyoda ..... 123/682
5,485,382 A * 1/1996 Seki et al. ..... 701/109
5,505,184 A * 4/1996 Uchikawa ..... 123/674
5,941,212 A * 8/1999 Murakami et al. ..... 123/325

FOREIGN PATENT DOCUMENTS

JP 6-249028 9/1994
JP 10-184425 7/1998

* cited by examiner

*Primary Examiner*—Willis R. Wolfe
*Assistant Examiner*—Douglas A Salser
(74) *Attorney, Agent, or Firm*—McDermott, Will & Emery

(57) ABSTRACT

An intake air quantity detected by an air flow meter is corrected based on a change speed of an engine load and on a change speed of an engine rotation speed, and an oxygen quantity stored in a catalytic converter is estimated based on the corrected intake air quantity and an oxygen concentration in the exhaust gas.

15 Claims, 2 Drawing Sheets

DEVICE AND METHOD FOR CONTROLLING AIR-FUEL RATIO OF INTERNAL COMBUSTION ENGINE

BACKGROUND OF THE INVENTION

1. Field of the Invention

The present invention relates to a device and method for controlling an air-fuel ratio of an internal combustion engine, in which an air-fuel ratio of a combustion mixture is controlled based on an oxygen quantity stored in a catalytic converter.

2. Related Art of the Invention

Heretofore, there is known an air-fuel ratio control device that estimates an oxygen quantity stored in a catalytic converter based on an air-fuel ratio to be detected by an oxygen sensor disposed upstream of the catalytic converter and an intake air quantity of an engine, to control an air fuel ratio of the combustion mixture so that the stored oxygen quantity reaches a target value (refer to Japanese Unexamined Patent Publication Nos. 6-249028, 10-184425).

The oxygen quantity stored in the catalytic converter can be accurately estimated from the intake air quantity when the engine is in steady operation. When the engine is in transient operation, however, since a change in exhaust gas quantity flowing into the catalytic converter is delayed behind a change in intake air quantity, there occurs an estimation error in the oxygen quantity stored in the catalytic converter leading a possibility of deterioration in the control precision of air-fuel ratio.

SUMMARY OF THE INVENTION

It is therefore an object of the present invention to provide a device and method for controlling an air-fuel ratio of an internal combustion engine which is capable of estimating an oxygen quantity stored in a catalytic converter based on an intake air quantity with high precision and, hence, of maintaining the control precision of air-fuel ratio.

In order to accomplish the above object, according to the present invention, a detection value of the intake air quantity is corrected based on transient operation conditions, and the oxygen quantity stored in the catalytic converter is estimated based on the above corrected intake air quantity and an oxygen concentration in the exhaust.

The other objects and features of this invention will become understood from the following description with reference to the accompanying drawings.

PREFERRED EMBODIMENT

Figure 1:
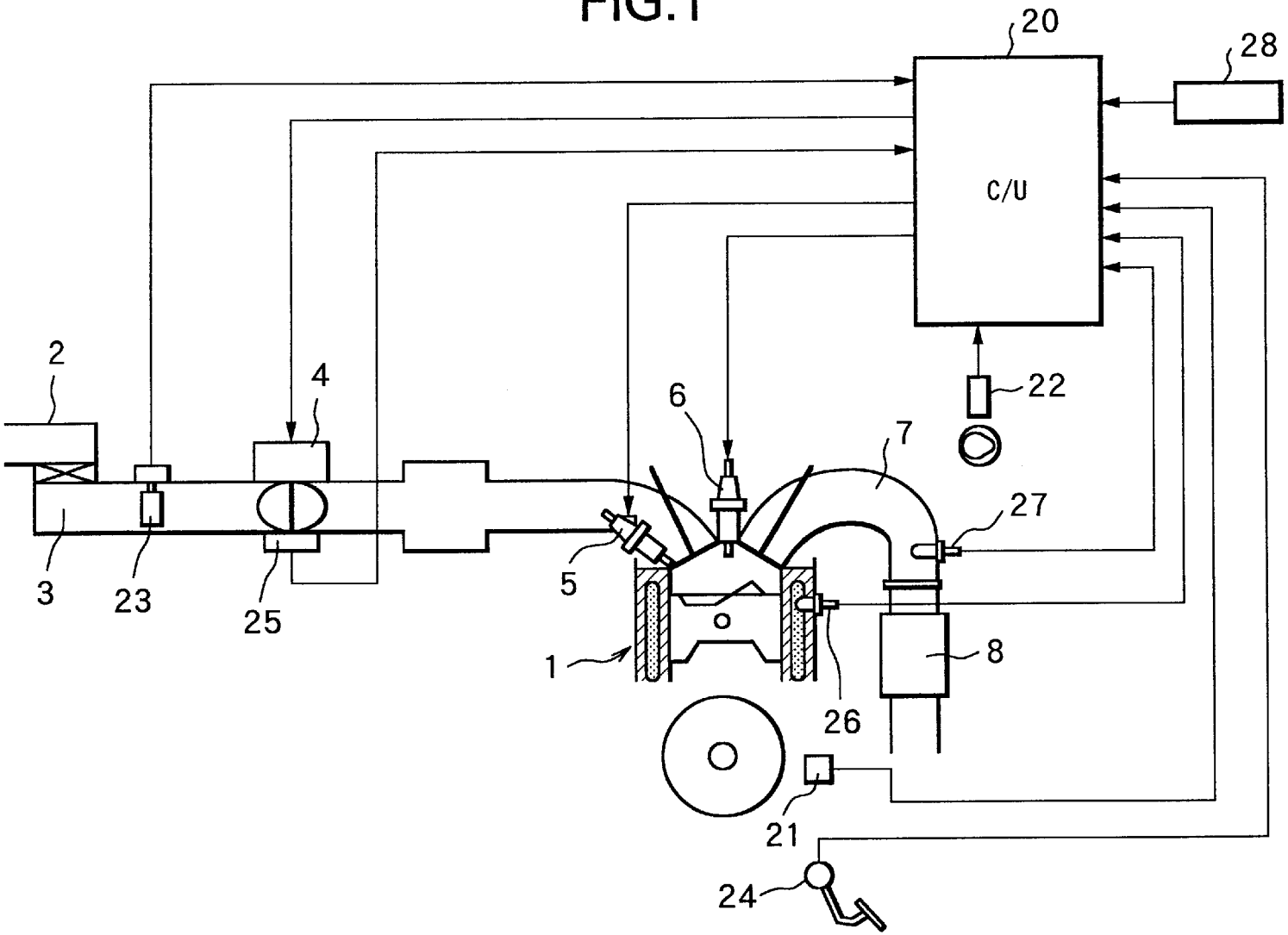
FIG. 1 is a diagram illustrating a system structure of an internal combustion engine according to an embodiment.

FIG. 1 is a diagram showing the system structure of an internal combustion engine according to an embodiment.

In FIG. 1, air is sucked into a combustion chamber of each cylinder in an internal combustion engine 1 mounted on a vehicle via an air cleaner 2, an intake passage 3, and an electronic controlled throttle valve 4 driven to open/close by a motor.

An electromagnetic fuel injection valve 5 is further disposed to inject fuel directly into the combustion chamber of each cylinder, and an air-fuel mixture is formed within the combustion chamber by the fuel injected by fuel injection valve 5 and the air sucked into the combustion chamber.

Fuel injection valve 5 is supplied with the power to a solenoid thereof by an injection pulse signal output from a control unit 20, to inject fuel adjusted to a predetermined pressure.

The air-fuel mixture formed within the combustion chamber is ignited by an ignition plug 6 to be combusted.

However, internal combustion engine 1 is not limited to the aforementioned direct injection type gasoline engine, but may be an internal combustion engine where fuel is injected into an intake port.

The exhaust of engine 1 is discharged through an exhaust passage 7.

Exhaust passage 7 is disposed with a catalytic converter 8 for purifying the exhaust.

Catalytic converter 8 is a three-way catalytic converter having the oxygen storing ability, to oxidize carbon monoxide CO, hydrocarbon HC and to reduce nitric oxide NOx, being the three harmful components included in the exhaust, thereby converting them into harmless carbon dioxide, water vapor and nitrogen.

The purification performance of three-way catalytic converter 8 is the greatest when an air-fuel ratio is a stoichiometric air-fuel ratio. When the air-fuel ratio is lean and the oxygen quantity is excessive, the oxidizing action becomes active but the reducing action becomes inactive, and in reverse, when the air-fuel ratio is rich and the oxygen quantity is low, the oxidizing action becomes inactive but the reducing action becomes active.

However, since three-way catalytic converter 8 has the oxygen storing ability, when the air-fuel ratio becomes temporarily rich, the oxygen stored in catalytic converter 8 is used, and when the air-fuel ratio becomes temporarily lean, the excessive oxygen is stored in catalytic converter 8 so that the exhaust purification performance can be maintained.

Accordingly, in order to be able to reduce nitric oxide NOx when the air-fuel ratio becomes leaner than the stoichiometric air-fuel ratio and also to oxidize carbon monoxide CO and hydrocarbon HC when the air-fuel ratio becomes richer than the stoichiometric air-fuel ratio, it is required to maintain the oxygen quantity to be stored in three-way catalytic converter 8 to approximately half the maximum storage amount, so that excessive oxygen can be stored to the catalytic converter when needed and so that oxygen necessary for the oxidation process can be supplied by eliminating from the stored oxygen when needed.

Therefore, control unit 20 mentioned above estimates the stored oxygen quantity in three-way catalytic converter 8, and feedback controls a fuel injection quantity of fuel injection valve 5 so that when the estimated stored oxygen quantity is smaller than a target quantity, the air-fuel ratio is shifted to lean so as to increase the stored oxygen quantity, whereas when the estimated stored oxygen quantity is greater than the target quantity, the air-fuel ratio is shifted to rich so as to reduce the stored oxygen quantity.

Control unit 20 incorporates therein a microcomputer including CPU, ROM, RAM, A/D converter, input/output interface and the like, and receives input signals from various sensors.

Based on the input signals from various sensors, control unit 20 controls the opening of electronic controlled throttle valve 4, the injection quantity and injection timing of fuel injection valve 5, the ignition timing of ignition plug 6.

As various sensors, there is provided a crank angle sensor 21 that detects a crank angle of engine 1 and a cam sensor 22 that takes out cylinder discrimination signals from a camshaft, and based on a signal from crank angle sensor 21, the rotation speed Ne of the engine is computed.

Other than the above, there is provided an airflow meter 23 that detects a new intake air quantity Q at the upstream of throttle valve 4 in intake passage 3, an accelerator sensor 24 that detects a depression quantity APS of an accelerator pedal, a throttle sensor 25 that detects the opening TVO of throttle valve 4, a water temperature sensor 26 that detects the cooling water temperature Tw of engine 1, an oxygen sensor 27 that detects in wide range an oxygen concentration within the exhaust, and a vehicle speed sensor 28 that detects the vehicle speed VSP.

Oxygen sensor 27 is for outputting a detection signal in accordance with the oxygen concentration in the exhaust, and the air-fuel ratio (excess air ratio) of the combustion mixture can be detected based on the detection signal.

Now, the air-fuel ratio control of control unit 20 based on the stored oxygen quantity is explained with reference to a block diagram of FIG. 2.

Figure 2:
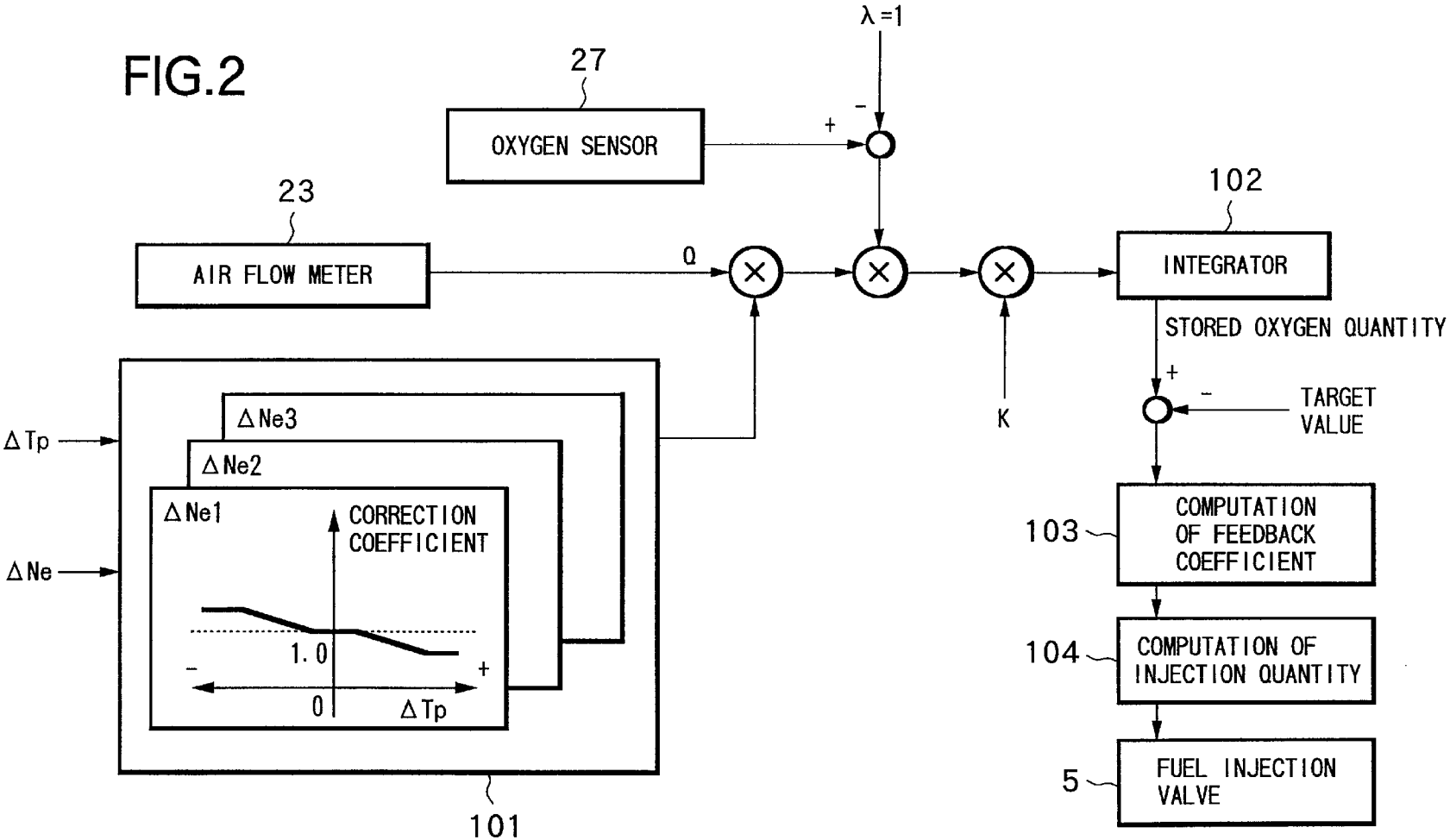
FIG. 2 is a block diagram illustrating the details of an air-fuel ratio control in the embodiment.

In the block diagram of FIG. 2, at a correction coefficient setting unit 101, a correction coefficient for correcting the intake air quantity Q detected by air flow meter 23 is set based on a differentiated value ΔTp of a basic fuel Injection quantity Tp that represents a change speed of engine load and a differentiated value ΔNe of an engine rotation speed Ne that represents a change speed of the engine rotation speed Ne.

To estimate the oxygen quantity stored in catalytic converter 8, it is necessary to obtain data related to an exhaust gas quantity flowing into catalytic converter 8. In this embodiment, the intake air quantity Q detected by air flow meter 23 is utilized as a parameter approximating the exhaust gas quantity flowing into catalytic converter 8, instead of direct detection of the exhaust gas quantity flowing into catalytic converter 8.

When the engine is in steady operation, the intake air quantity Q detected by air flow meter 23 approximately equals to the exhaust gas quantity flowing into catalytic converter 8. However, when the engine is in transient operation, since a phase of the exhaust gas quantity flowing into catalytic converter 8 is delayed behind a change in the intake air quantity Q, there occurs an error between the intake air quantity Q and the exhaust gas quantity actually flowing into catalytic converter 8.

The correction coefficient set by correction coefficient setting unit 101 is used for correcting the error between the intake air quantity Q and the exhaust gas quantity flowing into catalytic converter 8. When the engine load is changed to increase causing the differentiated value ΔTp to become positive, an increasing change in the exhaust gas quantity flowing into catalytic converter 8 is delayed behind an increasing change in the intake air quantity Q. Therefore, the intake air quantity Q is so corrected as to be decreased as the greater the differentiated value ΔTp becomes.

When the engine load is changed to decrease causing the differentiated value ΔTp to become negative, a decreasing change in the exhaust gas quantity flowing into catalytic converter 8 is delayed behind a decreasing change in the intake air quantity Q. Therefore, the intake air quantity Q is so corrected as to be increased as the smaller the differentiated value ΔTp becomes.

Further, in order to perform a fine correction on basic characteristics of the correction coefficient for the differentiated value ΔTp by using a differentiated value ΔNe of the engine rotation speed Ne, a table storing a correction coefficient corresponding to the differentiated value ΔTp is stored in advance for each differentiated value ΔNe.

However, the correction coefficient may be set based on only the differentiated value ΔTp that represents the change speed of the engine load. Or, a change speed of the throttle opening may be used as a parameter that represents the change speed of the engine load.

Further, since a primary delay correction is performed on the intake air quantity Q by the correction using the above correction coefficient, instead of the correction of the intake air quantity Q by using the above correction coefficient, an output signal of air flow meter 23 or data related to the intake air quantity may be processed by using an analog filter or a digital filter that is set to a primary delay transfer function, or the data related to the intake air quantity Q may be weighted and averaged. In this case, it is preferable to change a time constant of the filter and the weighting in the weighted mean operation depending on the operation conditions such as the engine load and the rotation speed.

The correction coefficient set by correction coefficient setting unit 101 is multiplied on the intake air quantity Q detected by air flow meter 23.

On the other hand, an air-fuel ratio deviation Δλ is obtained by subtracting 1 corresponding to the stoichiometric air-fuel ratio from the excess air ratio detected by oxygen sensor 27.

Then, the data related to the intake air quantity Q after multiplied by the above correction coefficient is multiplied by the above air-fuel ratio deviation Δλ.

The air-fuel ratio deviation Δλ becomes a positive value when the air-fuel ratio of the combustion mixture is leaner than the stoichiometric air-fuel ratio, while becomes a negative value when it is rich.

The multiplication result of the intake air quantity Q and the air-fuel ratio deviation Δλ is further multiplied by a constant K. This multiplication result is successively integrated by an integrator 102. A value integrated by integrator 102 represents the oxygen quantity stored in catalytic converter 8.

Here, the intake air quantity Q used for estimating the stored oxygen quantity is corrected corresponding to the delay in the exhaust gas quantity with respect to the change in the intake air quantity Q. Therefore, even in the transient operation condition, the stored oxygen quantity can be estimated depending on the exhaust gas quantity actually flowing into catalytic converter 8.

Next, a deviation is operated between an estimated value of stored oxygen quantity output from integrator 102 and the target value that is about half the maximum stored oxygen quantity.

At a feedback coefficient operation unit 103, a feedback correction coefficient of the air-fuel ratio is computed based on data related to the deviation of the stored oxygen quantity, That is, the feedback correction coefficient is set so that the air-fuel ratio is shifted to lean to increase the stored oxygen quantity when the stored oxygen quantity is smaller than the target quantity, and conversely, the air-fuel ratio is shifted to rich to decrease the stored oxygen quantity by eliminating excessive oxygen when the stored oxygen quantity is greater than the target quantity.

At an injection quantity operation unit 104, the basic fuel injection quantity Tp corresponding to the cylinder intake air quantity computed based on the intake air quantity Q and the engine rotation speed Ne is corrected by using the feedback correction coefficient to obtain a final fuel injection quantity Ti, and an injection pulse signal corresponding to the final fuel injection quantity Ti is output to fuel injection valve 5.

In the foregoing, the intake air quantity Q is detected by air flow meter 23. However, similarly to the described above, it becomes possible to avoid a deterioration in the estimating precision of the stored oxygen quantity at the transient operation if the stored oxygen quantity is estimated by performing the delay correction on the detection value of the intake air quantity, in a constitution in which the intake air quantity is detected based on an intake air pressure or in a constitution in which the intake air quantity is estimated from the throttle opening and the engine rotation speed.

The entire contents of Japanese Patent Application No. 2000-373500 filed Dec. 7, 2000 are incorporated herein by reference.

What is claimed:

1. A device for controlling an air-fuel ratio of an internal combustion engine, comprising:

a fuel injection valve that injects fuel to said engine;

a catalytic converter disposed in an exhaust pipe of said engine;

an intake air quantity detector that detects an intake air quantity of said engine;

an oxygen sensor that detects an oxygen concentration in the exhaust gas of said engine;

a transient operation detection unit that detects a transient operation condition of said engine;

an intake air quantity correction unit that corrects the intake air quantity detected by said intake air quantity detector based on said transient operation condition;

a stored oxygen quantity estimation unit that estimates an oxygen quantity stored in said catalytic converter based on the intake air quantity corrected based an said transient operation condition and on said oxygen concentration, and an injection quantity control unit that controls a fuel injection quantity by said fuel injection valve based on said stored oxygen quantity.

2. A device for controlling an air-fuel ratio of an internal combustion engine according to claim 1, wherein said intake air quantity correction unit performs a correction for delaying a phase of the detection value of the intake air quantity when said engine is in transient operation.

3. A device for controlling an air-fuel ratio of an internal combustion engine according to claim 1, wherein said transient operation detection unit comprises:

a load detection unit that detects an engine load on; and a change speed operation unit that computes a change speed of said engine load; and wherein said intake air quantity correction unit corrects said intake air quantity depending on the change speed of said engine load.

4. A device for controlling an air-fuel ratio of an internal combustion engine according to claim 3, wherein said intake air quantity correction unit corrects said intake air quantity to be decreased, as the higher the change speed of the engine load in an increase direction is, and corrects said intake air quantity to be increased, as the higher the change speed of the engine load in a decrease direction is.

5. A device for controlling an air-fuel ratio of an internal combustion engine according to claim 1, wherein said transient operation detection unit comprises:

a load detection unit that detects an engine load;

a rotation speed detection unit that detects an engine rotation speed;

a load change speed operation unit that computes a change speed of the engine load; and a rotation change speed operation unit that computes a change speed of said engine rotation speed, and wherein said intake air quantity correction unit corrects said intake air quantity depending on the change speed of said engine load and the change speed of said engine rotation speed.

6. A device for controlling an air-fuel ratio of an internal combustion engine according to claim 1, wherein said injection quantity control unit feedback controls said fuel injection quantity so that said stored oxygen quantity approaches a target value.

7. A device for controlling an air-fuel ratio of an internal combustion engine according to claim 1, wherein said stored oxygen quantity estimation unit comprises:

an air-fuel ratio deviation operation unit that computes a deviation between an air-fuel ratio corresponding to said oxygen concentration and a stoichiometric air-fuel ratio;

a multiplication unit that multiplies said air-fuel ratio deviation and the intake air quantity corrected based on said transient operation condition; and an integration unit that integrates said multiplication result.

8. A device for controlling an air-fuel ratio of an internal combustion engine, comprising:

a fuel injection valve that injects fuel to said engine;

a catalytic converter disposed in an exhaust pipe of said engine;

intake air quantity detecting means for detecting an intake air quantity of said engine;

oxygen concentration detecting means for detecting an oxygen concentration in the exhaust gas of said engine;

load detecting means for detecting an engine load on;

change speed computing means for computing a change speed of said engine load;

intake air quantity correcting means for correcting the intake air quantity based on the change speed of said engine road;

stored oxygen quantity estimating means for estimating an oxygen quantity stored in said catalytic converter based on the corrected intake air quantity and said oxygen concentration, and injection quantity control means for controlling a fuel injection quantity by said fuel injection valve based on said stored oxygen quantity.

9. A method of controlling an air-fuel ratio of an internal combustion engine, comprising the steps of:

detecting a transient operation condition of said engine;

detecting an intake air quantity of said engine;

detecting an oxygen concentration in the exhaust gas of said engine;

a transient operation detection unit that;

correcting said intake air quantity based on said transient operation condition;

estimating an oxygen quantity stored in a catalytic converter disposed in an exhaust pipe of said engine based on the said corrected intake air quantity and said oxygen concentration, and controlling an air-fuel ratio of a combustion mixture of said engine.

10. A method of controlling an air-fuel ratio of an internal combustion engine according to claim 9, wherein said step of correcting an intake air quantity performs a correction for delaying a phase of the detection value of the intake air quantity when said engine is in transient operation.

11. A method of controlling an air-fuel ratio of an internal combustion engine according to claim 9, wherein said step of detecting a transient operation condition comprises the steps of:

detecting an engine load on; and computing a change speed of said engine load; and wherein said step of correcting an intake air quantity corrects said intake air quantity depending on the change speed of said engine load.

12. A method of controlling an air-fuel ratio of an internal combustion engine according to claim 11, wherein said step of correcting an intake air quantity corrects said intake air quantity to be decreased, as the higher the change speed of the engine load in an increase direction is, and corrects said intake air quantity to be increased, as the higher the change speed of the engine load in a decrease direction is.

13. A method of controlling an air-fuel ratio of an internal combustion engine according to claim 9, wherein said step of detecting a transient operation condition comprises the steps of:

detecting an engine load;

detecting an engine rotation speed;

computing a change speed of said engine load; and computing a change speed of said engine rotation speed, and wherein said step of correcting an intake air quantity correcting said intake air quantity depending on the change speed of said engine load and the change speed of said engine rotation speed.

14. A method of controlling an air-fuel ratio of an internal combustion engine according to claim 9, wherein said step of controlling a combustion mixture feedback controlling said air-fuel ratio so that said stored oxygen quantity approaches a target value.

15. A method of controlling an air-fuel ratio of an internal combustion engine according to claim 9, wherein said step of estimating a stored oxygen quantity comprises the steps of:

computing a deviation between an air-fuel ratio corresponding to said oxygen concentration and a stoichiometric air-fuel ratio;

multiplying said air-fuel ratio deviation and the intake air quantity corrected based on said transient operation condition; and integrating said multiplication result.

* * * * *